United States Patent [19]

Lo

[11] Patent Number: 4,997,181

[45] Date of Patent: Mar. 5, 1991

[54] WIND-DRAG TYPE EXERCISE ROWING UNIT

[76] Inventor: Peter K. Lo, No. 26, Ching-Chuan Rd., Ching-Chuan Kang, Ta-Ya Hsiang, Taichung Hsien, Taiwan

[21] Appl. No.: 313,059

[22] Filed: Feb. 21, 1989

[51] Int. Cl.[5] ..... A63B 21/02

[52] U.S. Cl. ..... 272/72; 272/128

[58] Field of Search ..... 272/72, 130, 128, DIG. 6, 272/71, 132, 118; 128/25 R

[56] References Cited

U.S. PATENT DOCUMENTS

| | | | |
|---|---|---|---|
| 4,396,188 | 8/1983 | Dreissigacker et al. | 272/72 |
| 4,537,396 | 8/1985 | Hooper | 272/130 |
| 4,647,035 | 3/1987 | Yellen | 272/72 |

*Primary Examiner*—Stephen R. Crow

[57] ABSTRACT

A wind-drag type exercise rowing unit includes a generally horizontally extending frame on which a wind-drag type flywheel is mounted. A seat and a foot rest unit are fixed on the frame for supporting an operator. A large belt pulley is mounted on the frame and connected to a rope sheave by means of a one-way clutch. An endless belt is carried on the large belt pulley and a small belt pulley which is secured to the flywheel. A rope is wound around the sheave and secured to the same at one end to a handle at the other end. When the handle is pulled away from the sheave, the sheave is rotated in a direction which causes the clutch to unlock the large belt pulley from the sheave. When the rope is released, the sheave is returned to its static position by a spiral spring. The return rotation of the sheave causes the large belt pulley to be locked on the sheave so that the large belt pulley rotates synchronously with the sheave, thereby driving the small belt pulley and the flywheel. The higher the rotational speed of the flywheel, the greater the air resistance encountered by the fan-type blades of the flywheel. As a result, the rotation of the sheave can be transferred smoothly and quietly to the flywheel by means of the belt and the belt pulleys.

1 Claim, 3 Drawing Sheets

WIND-DRAG TYPE EXERCISE ROWING UNIT

BACKGROUND OF THE INVENTION

This invention relates to a wind-drag type exercise rowing unit, more particularly to a rowing unit in which the rowing action can be converted into the rotation of a wind-drag type flywheel.

The improvement of this invention is directed to a wind-drag type exercise rowing unit which is disclosed in U.S. Pat. No. 4,396,188, issued to Dreissigacker et al on Aug. 2, 1983. This patent teaches a wind-drag type flywheel which has a plurality of fan-type blades When the flywheel rotates, the blades encounter air resistance which tends to decelerate the flywheel, thereby serving as a braking unit. This rowing unit suffers from the following disadvantages: (1) Because a chain extends through a frame by means of chain guides, the wear between the chain and the frame creates much noise when the chain is moved. (2) Because the rowing action of the operator results in instant impulse between the chain and a sprocket which is coupled with the flywheel, the lifetime of the chain is reduced and the noise incurred by the action between the chain and the sprocket is increased.

SUMMARY OF THE INVENTION

It is therefore the main object of this invention to provide a wind-drag type exercise rowing unit which can be operated quietly.

According to this invention, a wind-drag type exercise rowing unit includes a generally horizontally extending frame on which a wind-drag type flywheel is mounted. A seat and a foot rest unit are fixed on the frame for supporting an operator. A large belt pulley is mounted on the frame and connected to a rope sheave by means of a one-way clutch. An endless belt is carried on the large belt pulley and a small belt pulley which is secured to the flywheel. A rope is wound around the sheave and secured to the same at one end and to a handle at the other end. When the handle is pulled away from the sheave, the sheave is rotated in a direction which causes the clutch to unlock the large belt pulley from the sheave. When the rope is released, the sheave is returned to its static position by a spiral spring. The return rotation of the sheave causes the large belt pulley to be locked on the sheave so that the large belt pulley rotates synchronously with the sheave, thereby driving the small belt pulley and the flywheel. The higher the rotational speed of the flywheel, the greater the air resistance encountered by the fan-type blades of the flywheel. As a result, the rotation of the sheave can be transferred smoothly and quietly to the flywheel by means of the belt and the belt pulleys.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
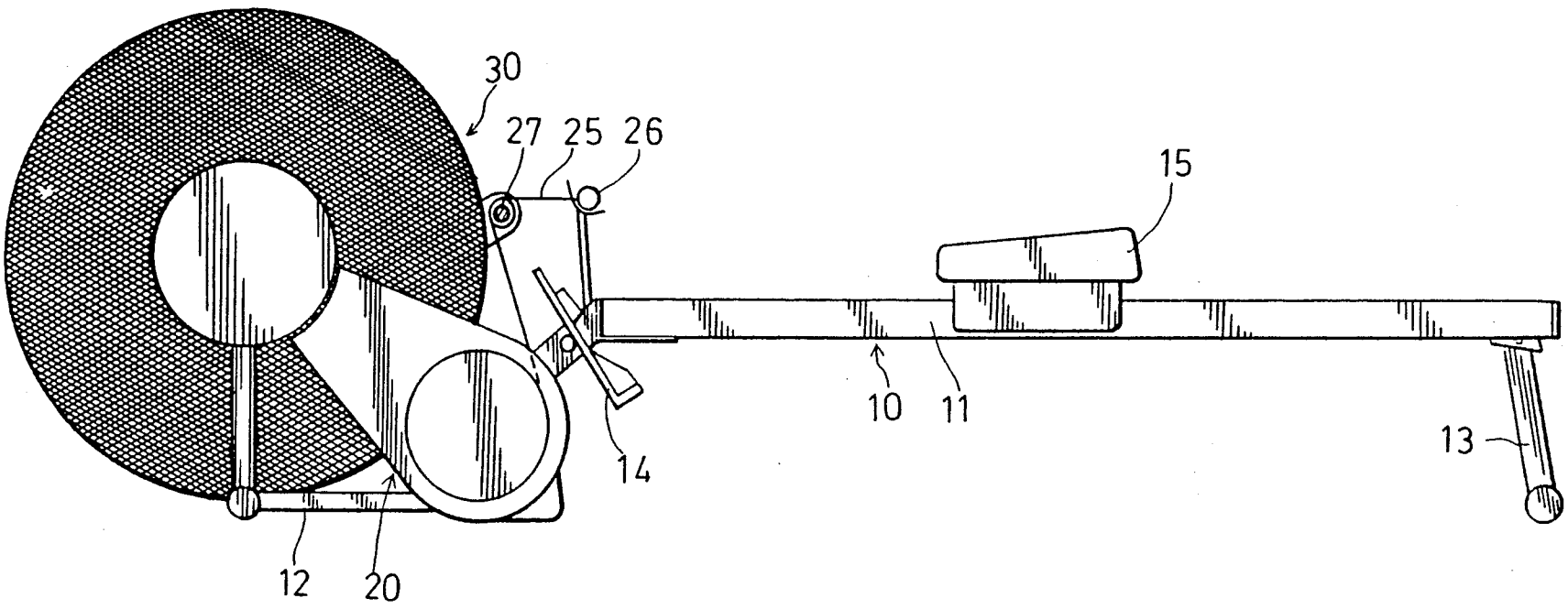
FIG. 1 is a side view of a wind-drag type exercise rowing unit according to this invention.

Referring to FIG. 1, a wind-drag type exercise rowing unit of this invention includes a frame 10, a rope-operated unit 20 and a flywheel 30.

The frame 10 has a substantially horizontally extending body 11, a flywheel support 12 connected securely to the front end of the body 11, a rear leg unit 13, a pair of foot rests 14 secured to the front end portion of the body 11, and a slidable seat 15 disposed on the body 11 between the foot rests 14 and the rear leg unit 13.

The rope-operated unit 20 includes a rotating shaft 21 journalled on the flywheel support 12, a rope sheave 22 sleeved rigidly on the rotating shaft 21, a large belt pulley 23 sleeved rotatably on the rotating shaft 21, and a spiral spring 24 interconnecting the rotating shaft 21 and the flywheel support 12. The sheave 22 has a helical groove (G) along which a rope 25 is wound. The rope 25 is secured to the sheave 22 at one end thereof and to a handle 26 at the other end of the rope 25. A guide pulley 27 is fixed on the flywheel support 12 so as to guide the rope 25 to extend. Therefore, the handle 26 can be held comfortably by the operator. A one-way clutch 28 interconnects the sheave 22 and the large belt pulley 23 for locking the large belt pulley 23 on the sheave 22 only when the sheave 22 rotates counterclockwise.

The flywheel 30 is mounted on the front end of the flywheel support 12 and has an axle on which a small belt pulley 31 is sleeved rigidly. A V-belt 32 is carried on the small belt pulley 31 and the large belt pulley 23.

Figure 2:
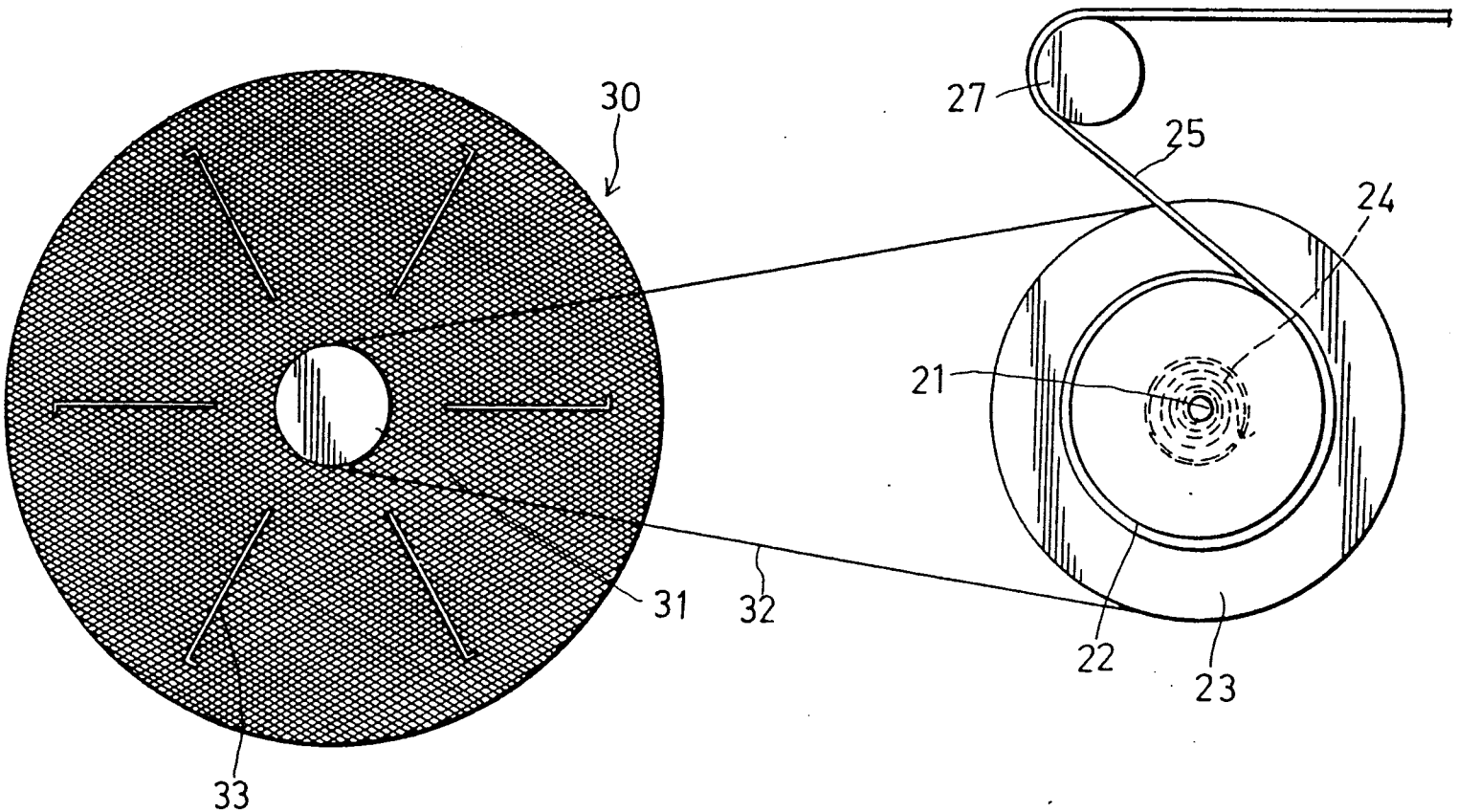
FIG. 2 is a schematic side view illustrating the operation of the rowing unit according to this invention.
Figure 3:
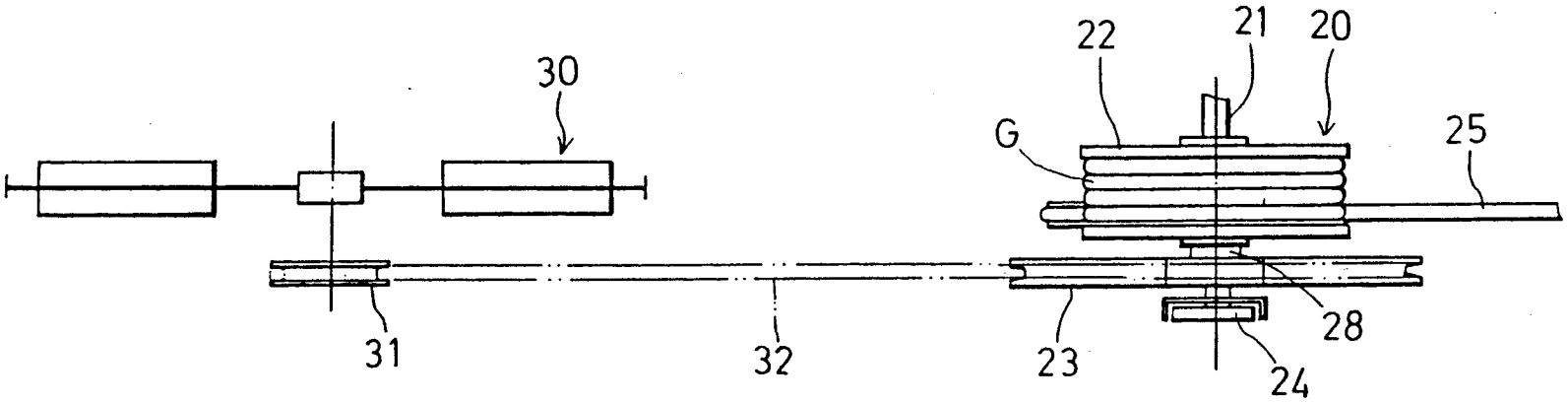
FIG. 3 is a schematic top view illustrating the operation of the rowing unit according to this invention.

Referring to FIGS. 2 and 3, in operation, when the handle 26 is pulled backward, the sheave 22 rotates clockwise. At this time, the large belt pulley 23 is unlocked from the sheave 22 by means of the one-way clutch 28. When the handle 26 is released and moves forward, the sheave 22 is rotated counterclockwise by the spring 24. Counterclockwise rotation of the sheave 22 causes the one-way clutch 28 to interlock the sheave 22 and the large belt pulley 23 so as to rotate the large belt pulley 23 counterclockwise.

Several fan-type blades 33 are provided on the flywheel 30 in a known manner. The higher the rotational speed of the flywheel 30, the greater the air resistance encountered by the blades 33 of the flywheel 30.

With this invention thus explained, it is apparent that numerous modifications and variations can be made without departing from the scope and spirit of this invention. It is therefore intended that this invention be limited only as indicated in the appended claims.

I claim:

1. A stationary rowing unit comprising:

a generally horizontally extending frame including a seat mounted movably lengthwise on said frame, and a foot rest unit secured to a front portion of said frame;

a flywheel mounted on a front end portion of said frame and having a plurality of fan-type blades secured to said flywheel so as to resist rotation of said flywheel;

a rope sheave mounted on said frame between said flywheel and said seat, and having a helical groove formed in said rope sheave;

a rope wound around said rope sheave along said helical groove and secured to said rope sheave at one end of said rope;

a handle secured to the other end of said rope for rotating said rope sheave by pulling said rope away from said rope sheave;

a spiral spring connected to said rope sheave for returning said rope sheave to a static position when said rope is released;

a large belt pulley mounted on said frame near said rope sheave;

a one-way clutch interconnecting said rope sheave and said large belt pulley so as to rotate said large belt pulley synchronously with said rope sheave when said rope is released, said rope sheave being incapable of driving said large belt pulley when said rope is pulled away from said rope sheave;

a small belt pulley secured to said flywheel; and a belt carried on said large and small belt pulleys so that both said small belt pulley and said flywheel can rotate with said large belt pulley.

* * * * *